US010924840B2

(12) United States Patent
Kuhtz

(10) Patent No.: US 10,924,840 B2
(45) Date of Patent: Feb. 16, 2021

(54) EARPHONES WITH REMOVABLE CONNECTION CABLE

(71) Applicant: Sennheiser electronic GmbH & Co. KG, Wedemark (DE)

(72) Inventor: Jan Peter Kuhtz, Celle (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 16/645,035

(22) PCT Filed: Sep. 12, 2018

(86) PCT No.: PCT/EP2018/074562

§ 371 (c)(1),
(2) Date: Mar. 6, 2020

(87) PCT Pub. No.: WO2019/053042

PCT Pub. Date: Mar. 21, 2019

(65) Prior Publication Data

US 2020/0267466 A1 Aug. 20, 2020

(30) Foreign Application Priority Data

Sep. 13, 2017 (DE) ..... 10 2017 121 137

(51) Int. Cl.
*H04R 1/10* (2006.01)

(52) U.S. Cl.
CPC ..... *H04R 1/1033* (2013.01); *H04R 1/1016* (2013.01); *H04R 2420/09* (2013.01)

(58) Field of Classification Search
CPC . H04R 1/1033; H04R 1/1016; H04R 2420/09
USPC ..... 381/74, 309, 322, 324, 323, 370, 150, 381/384, 312, 328, 380
See application file for complete search history.

(56) References Cited

U.S. PATENT DOCUMENTS 2,272,432 A 2/1942 Rogie
9,357,281 B2 5/2016 Aoyagi et al.
9,615,160 B1 * 4/2017 Mothaffar ..... H04R 1/1041
(Continued)

FOREIGN PATENT DOCUMENTS

CN 102 300 138 12/2011
CN 103 686 507 3/2014
(Continued)

OTHER PUBLICATIONS

Search Report for Application No. PCT/2018/074562 dated Nov. 29, 2018.

*Primary Examiner* — Thjuan K Addy
(74) *Attorney, Agent, or Firm* — Haug Partners LLP

(57) ABSTRACT

An earphone and connection cable can be connected to the housing of the earphone with a robust and reliable plug connection. The plug connection includes a coaxial plug having rotationally symmetrical plug contacts and is surrounded with a plastic encapsulation. When the plug connection is inserted the plastic encapsulation forms a first bearing location for receiving mechanical forces acting laterally on the plug while at least one of the plug contacts of the coaxial plug forms a second bearing location for receiving such forces. The distance from the first to the second bearing location in that case is greater than the diameter of the plug contacts of the coaxial plug.

15 Claims, 5 Drawing Sheets

(56) References Cited

U.S. PATENT DOCUMENTS

| | | | | |
|---|---|---|---|---|
| 2003/0002691 | A1* | 1/2003 | Ono | H04R 1/1033 381/94.1 |
| 2008/0019554 | A1 | 1/2008 | Krywko | |
| 2009/0010476 | A1 | 1/2009 | Pan | |
| 2011/0051973 | A1* | 3/2011 | Liu | H04R 1/1033 381/370 |
| 2014/0348340 | A1 | 11/2014 | Petersen | |
| 2015/0104035 | A1 | 4/2015 | Aoyagi et al. | |

FOREIGN PATENT DOCUMENTS

| | | |
|---|---|---|
| CN | 204 442 631 | 7/2015 |
| EP | 2 384 020 | 11/2011 |
| JP | 3 154 506 | 9/2009 |

* cited by examiner a)

b)

c)

EARPHONES WITH REMOVABLE CONNECTION CABLE

The present application is a national stage entry of PCT/EP2018/074562, filed on Sep. 12, 2018, which claims priority from German Patent Application No. 10 2017 121 137.3 filed on Sep. 13, 2017, the disclosures of which are incorporated herein by reference in their entirety.

The invention concerns a wired earphone for at least one ear, wherein the connection cable is removable.

BACKGROUND

Wired earphones are often used for example on stages, for speech communication systems or for listening to music. In contrast to headphones earphones are fixed in or to the ear and have a portion which can be at least partially inserted into the auditory canal. Therefore they are also referred to as in-ear earphones. Often that portion also serves for fixing the earphone to or in the ear of the user. Such fixing in the ear however is often not adequate, for example in the case of performers who are moving around on the stage.

In addition experience has shown that the connection cables of wired earphones are delicate and often give rise to problems like for example the cable breaks. Therefore earphones with a removable connection cable are known. In that case the connection cable is connected with a replaceable plug connection to the housing of the earphone, in which the sound transducer is disposed. That makes it possible to replace the cable when the housing and the sound transducer continue to be used. That is desirable as the sound transducer is generally the most valuable component of the earphone. In addition the housing can be individually matched for a user, which also makes it a valuable component. By virtue of its small size however the plug connection is also delicate and is often already damaged after just a few plug-in operations. Therefore an earphone with a robust and reliable plug connection for the connection cable would be desirable.

SUMMARY OF THE INVENTION

An object of the present invention is to provide a wired earphone which is easy to fit to or in the ear and which securely stays in place. In addition the invention seeks to provide that the connection cable can be connected to the housing of the earphone with a robust and reliable releasable plug connection.

That object is attained by the earphone recited in claim 1. Further advantageous embodiments are described in the dependent claims.

According to the invention an earphone includes at least a housing and a removable connection cable, wherein the connection cable is releasably fixed to the housing by way of a rotatable plug connection. The plug connection includes a coaxial plug having rotationally symmetrical, electrically conducting (metallic) plug contacts and is surrounded by a plastic encapsulation. When the plug connection is inserted the plastic encapsulation forms a first bearing location for receiving mechanical forces acting laterally on the plug while at least one of the plug contacts of the coaxial plug forms a second bearing location for receiving such forces. In that arrangement in particular mechanical stability is ensured by a distance from the first to the second bearing location being greater than the diameter of the coaxial plug.

The advantages of the earphone according to the invention include the fact that the plug connection is more robust and easier to handle than in the case of conventional earphones with a removable connection cable. In addition, before or after the connection cable is placed around the auricle the earphone can be more easily fitted into the ear because rotatability of the plug connection has been optimized.

BRIEF DESCRIPTION OF THE DRAWINGS

Further details and advantageous embodiments are illustrated in the drawings in which.

DETAILED DESCRIPTION OF THE INVENTION

Figure 1:
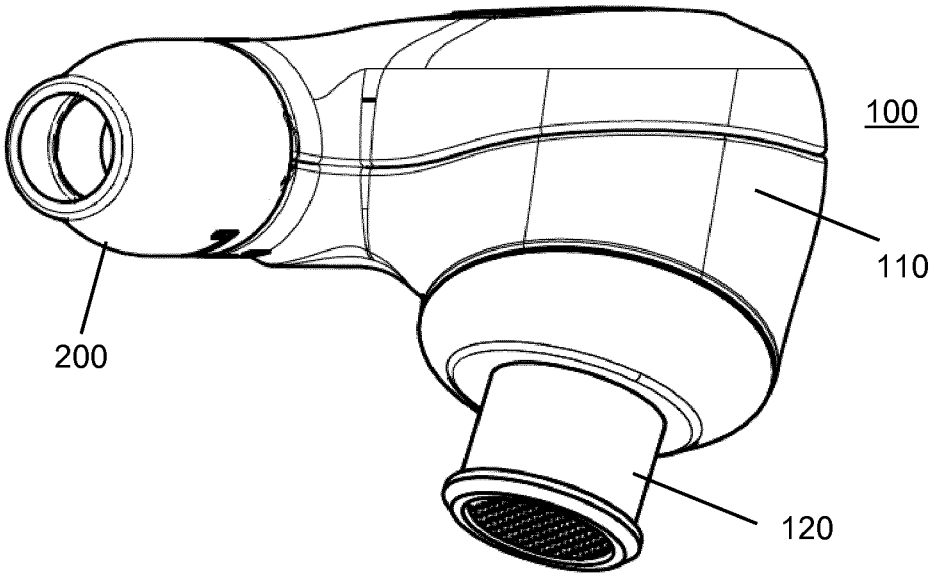
FIG. 1 shows an overall view of an earphone housing with cable plug without cable.

FIG. 1 shows by way of example an overall view of an earphone 100 according to the invention with removable cable. The earphone includes an earphone housing 110 (in one or more parts) and a connection cable, of which the Figure shows here only the cable plug 200 which is fitted into an opening in the housing 110. Disposed in the interior of the housing 110 is inter alia a sound transducer (not shown), the sound of which can be delivered by a connection 120 for an ear mold (not shown).

Figure 2:
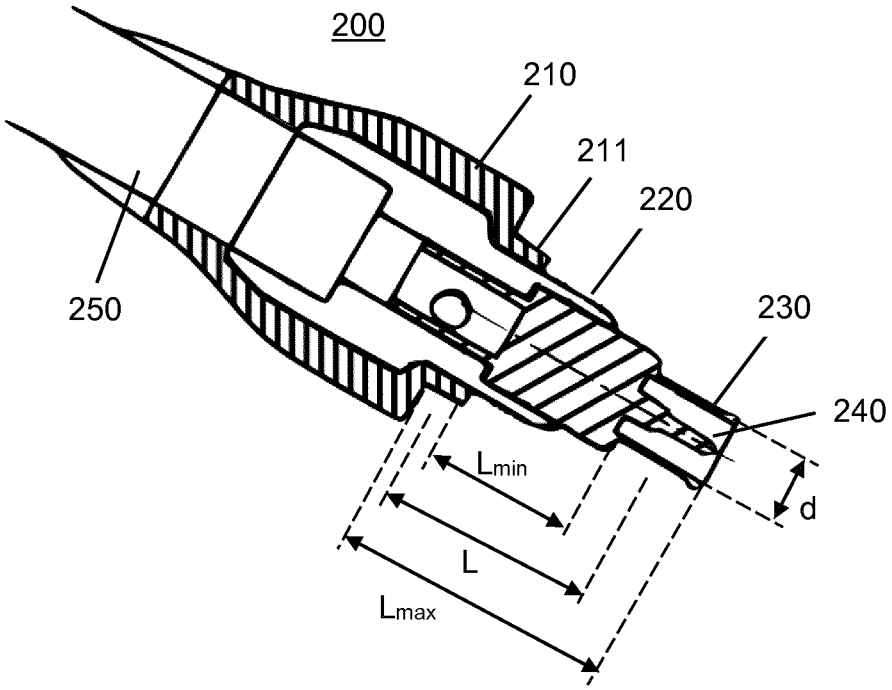
FIG. 2 shows a diagrammatic sectional view of a first embodiment of a plug of the connection cable.

FIG. 2 shows a diagrammatic side view of a first embodiment of a plug 200 of the connection cable 250. The plug 200 is a coaxial plug so that the plug connection is rotatable in the inserted state. Therefore the cable can be easily rotated on the earphone into a desired position, as is described in greater detail hereinafter. The coaxial plug has rotationally symmetrical metallic plug contacts 230, 240 and is enclosed with a plastic encapsulation 210, 220. The plug contacts 230, 240 include a central pin 240 and a cylindrical tubular outer contact 230, which are electrically insulated from each other (not shown). In this example the plastic encapsulation includes a first inner plastic encapsulation 220 and a second outer plastic encapsulation 210. The second plastic encapsulation 210 surrounds at least a portion of the first plastic encapsulation 220 and comprises a softer plastic than the first plastic encapsulation 220. For example the inner first plastic encapsulation 220 can comprise a hard plastic and the outer second plastic encapsulation 210 can comprise a rubber-like more elastic plastic. The size relationships shown in FIG. 2 are explained hereinafter.

Figure 3:
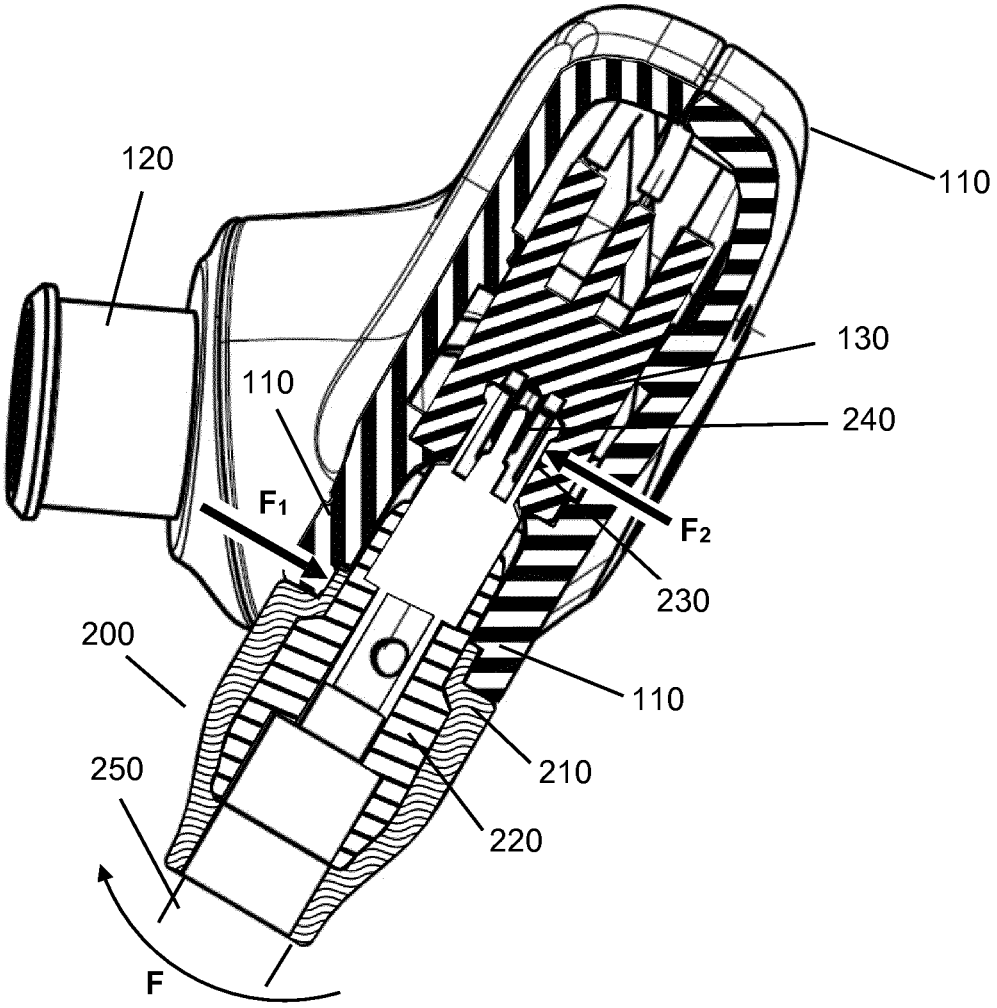
FIG. 3 shows a diagrammatic sectional view of the earphone housing with inserted cable plug of the first embodiment.

FIG. 3 shows a diagrammatic sectional view of the earphone housing 110 of the first embodiment with an electrical (that is to say electrically conductive) socket 130 and contacts 230, 240 inserted therein of a cable plug 200. The plug 200, corresponding to FIG. 2, has a softer outer plastic encapsulation 210 and a harder inner plastic encapsulation 220. When the earphone is being worn strong forces normally act on the cable and thus on the plug connection. A force acting on the cable 250 is transmitted to the housing 110 by way of the plug. While the plug connection can well carry axial forces, forces which act radially or laterally on the plug lead to problems when using conventional plug connections. In particular conventional plugs have a tendency to break off when radial forces are involved. According to the invention however the radial forces are diverted to the housing at least two bearing locations of the plug in the form of lateral forces $F_1$, $F_2$, more specifically at the outer plug contact 230 and at the plastic encapsulation 210. For that purpose the plug is inserted into a housing opening to such an extent that at least a front part of the plastic encapsulation or both plastic encapsulations 210, 220 are disposed in the opening and the plug 230, 240 is in the socket 130. In that case the two bearing locations are spaced from each other at least by the diameter of the plug contacts. Therefore the inserted plug has less room for movement in the socket of the earphone and does not wear so easily. Unlike the situation with conventional plug connections according to the invention practically no torque acts on the inner plug contact 240. An increase in the distance between the bearing locations further reduces the room for movement of the plug and therefore has an advantageous effect in accordance with the invention. It is to be noted that upon a reversal of the illustrated radial force F the forces $F_1$, $F_2$ acting on the housing engage the respectively opposite side, than as shown in FIG. 3.

The bearing locations and dimensions are shown in detail in FIG. 2. The forces act on the one hand on a first bearing location formed by the plastic encapsulation. In particular in this example the outer soft or elastic plastic encapsulation 210 has a shoulder 211 at which the first bearing location is to be found. The second bearing location is at the plug contacts 230, 240 of the coaxial plug. The exact position of the first bearing location can be anywhere in the region of the shoulder 211 while the exact position of the other bearing location can be anywhere in the region of the plug contacts 230, 240. Therefore the distance between the two bearing locations can vary between a minimum value $L_{min}$ and a maximum value $L_{max}$. A mean value L is assumed as a typical value. According to the invention that distance (even in the case of the minimum value $L_{min}$) is always greater than the diameter d of the (outer) plug contact 230 of the coaxial plug at the second bearing location. In an embodiment the ratio L/d between the distance L from the first to the second bearing location on the one hand and the diameter d of the plug contact on the other hand is in a range of 1.4-2.5, for example a value of L/d=2 is highly suitable.

The diameter of the shoulder 211 can be exactly matched to the size of the opening in the housing so that, when the plug is inserted, a press fit is formed. That however is axially rotatable so that the inserted cable can be rotated. That is advantageous in particular when the cable is of a given shape adapted to the auricle of the user (for example if the user has already previously worn the earphone). The user can then rotate the earphone relative to the cable in such a way that it fits comfortably in the ear. In that situation the cable should not be excessively easily rotatable so that it remains in its position as set by the user. Preferably the press fit is such that, to rotate the cable, a torque in a range of 0.7-2 Ncm is to be applied. In particular a value in the range of 1-1.5 Ncm is advantageous, for example 1.2 Ncm. With values below 0.5 Ncm it easily happens that the housing already rotates while being inserted. When the values are above 2 Ncm both insertion of the plug in the housing and also rotation into a desired position become difficult. An optimized torque can also be achieved in another way, for example by the plastic encapsulation not being rotationally symmetrical at least at the shoulder 211 (and/or the opening in the housing), but it being slightly oval or provided with a projection, or by the plug connection having one or more preferential positions which first have to be overridden for the purposes of rotation. For that purpose it is particularly advantageous if that part of the plastic encapsulation, in this example the outer plastic encapsulation 210, is soft or elastic. As however the plastic encapsulation must also stabilize the plug it is advantageous to provide an inner plastic encapsulation 220 made from harder material. The inner plastic encapsulation 220 permits strain relief in respect of the electrical connection between the strands of the cable 250 and the plug contacts 230, 240.

Figure 4:
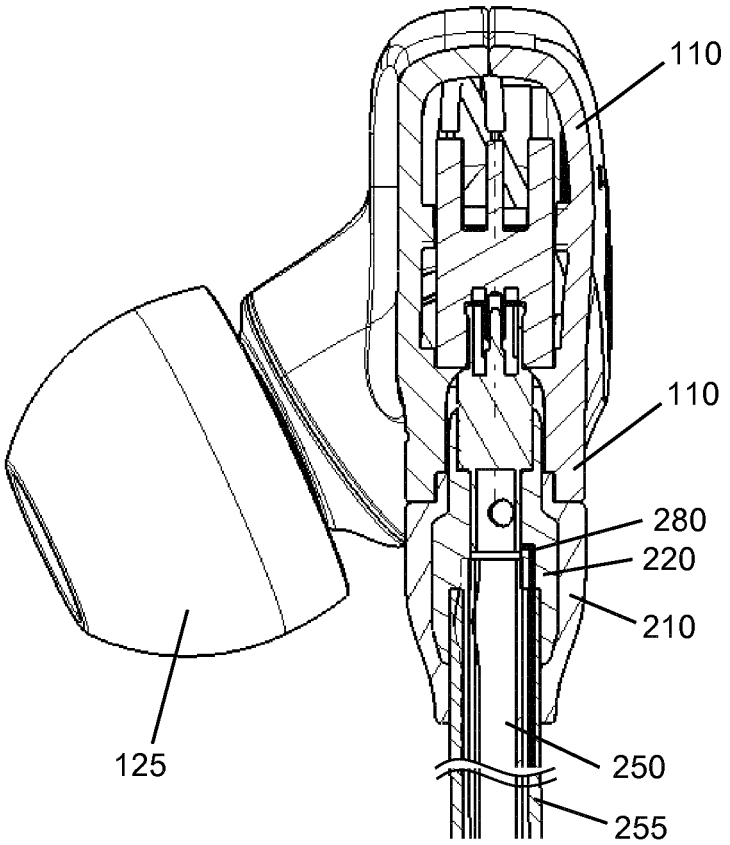
FIG. 4 shows a diagrammatic sectional view of the earphone housing with inserted cable plug of the first embodiment and inserted support wire.

That applies in particular to an embodiment as shown in FIG. 4, in which a support wire 280 is integrated into the region near the plug of the connection cable 250 and preferably into the sheathing 225 of the connection cable 250 or into an additional soft sleeve. FIG. 4 shows a diagrammatic sectional view of the earphone housing 110 with inserted cable plug and support wire 220 fitted into the connection cable. The wire provide that, in a region near the ear, the connection can be individually bent and remains in that shape. As a result the user can bend that region of the cable in such a way that it can be placed around the auricle and the hold of the earphone to the ear is improved. The individual bending option means that the earphone is to be comfortable for the user to wear. Within the plug the support wire 280 is molded in the plastic encapsulation or at least in the inner harder plastic encapsulation 220 and thereby durably fixed.

Figure 5:
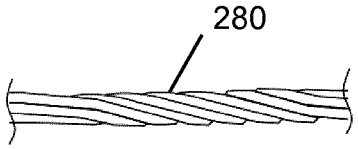
FIG. 5 shows a stranded support wire.

In an embodiment the support wire 280 is a simple wire. In another embodiment the support wire comprises a plurality of individual wires. It is particularly advantageous for a plurality of individual wires to be stranded or twisted together, as shown in FIG. 5. A stranded support wire is easy to bend and retains its shape, but is more resistant to fatigue breakage. Therefore a stranded wire does not break as easily as an individual wire.

Figure 6:
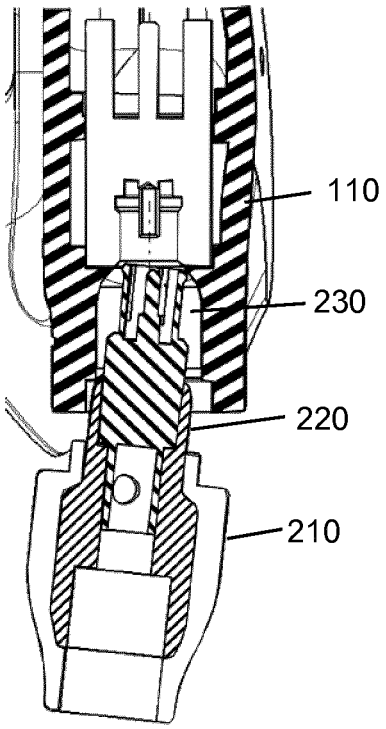
FIG. 6 shows a plug cycle.
Figure 6:
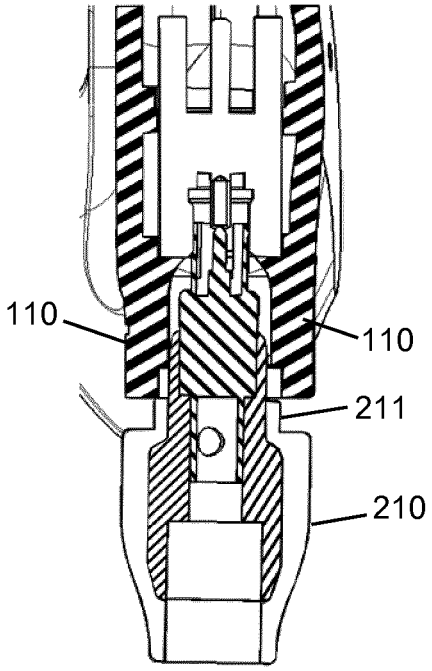
Figure 6:
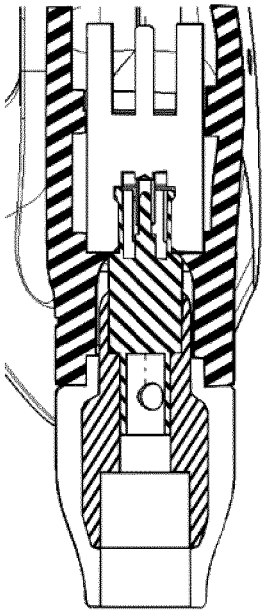

FIG. 6 diagrammatically shows in a plug cycle how the plug 200 of the connection cable is introduced into the housing 110. In that case the plug is often slightly tilted, as shown in FIG. 6*a*). It is advantageous here for the housing to be shaped with a constriction in the interior of the housing opening near the electric socket in such a way that the outer plug contact 230 of the plug is guided into the socket 130 without tilting. For example, around the electric socket 130 the bottom (or the end) of the housing opening can in principle be conical or funnel-like. Normally the outer contact 230 of a coaxial plug is at least as long as the inner contact 240 and therefore first comes into engagement. In an embodiment however the inner contact of the coaxial plug can be markedly longer than the outer one so that the funnel-like guidance action acts on the inner contact. It will be noted in that case however that the risk of bending the inner contact is greater because it is more delicate. In this example moreover the plastic encapsulation 220 of the plug is shaped in such a way that it narrows forwardly and therefore does not form any or only a very small edge, at which the plug could tilt upon being inserted. Instead of a conical guide configuration (with straight walls) it is also possible to use another guide configuration which narrows towards the socket and which is suitable for guiding the plug.

The guide configuration in the housing and the only small edge at the plug means that it is automatically forced into a straight position upon being inserted, as shown in FIG. 6*b*). When the plug is completely inserted the shoulder 211 of the plastic encapsulation 210 is pressed against the inside wall of the opening in the housing 110 and thus forms the above-described bearing location for carrying mechanical forces. At the same time the electrical plug contacts 230, 240 form a second bearing location.

Figure 7:
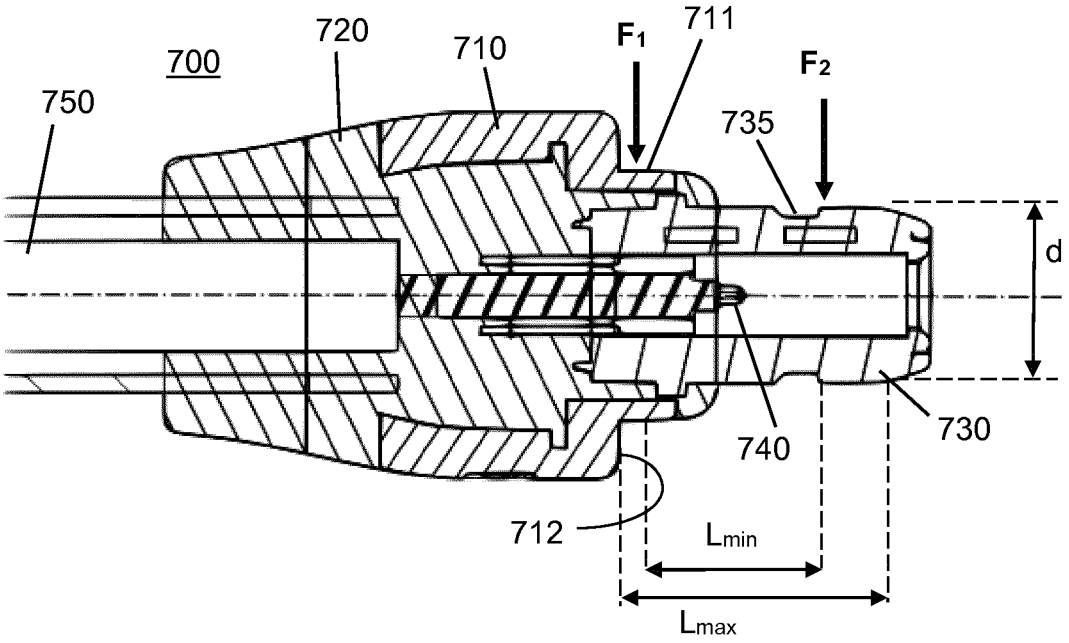
FIG. 7 shows a diagrammatic sectional view of a second embodiment of a plug of the connection cable.
Figure 8:
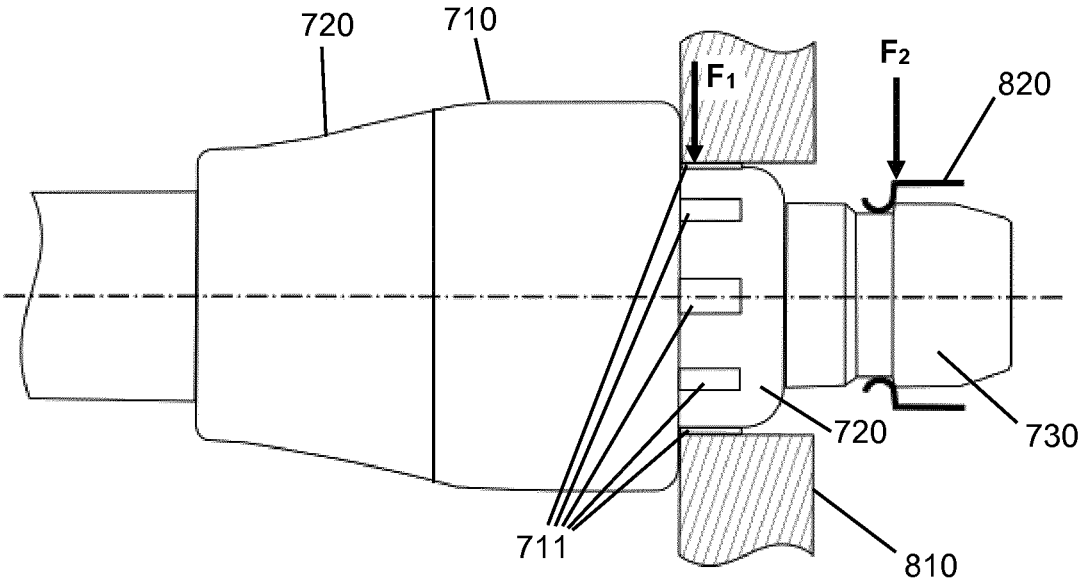
FIG. 8 shows bearing locations of a plug of the second embodiment, that is fitted into an earphone housing.

FIG. 7 shows a diagrammatic sectional view of a second embodiment of a plug 700 of the connection cable 750 while FIG. 8 diagrammatically shows the bearing locations of a plug fitted into an earphone housing of the second embodiment. As in the first embodiment the plug 700 is also a coaxial plug with rotationally symmetrical metallic plug contacts 730, 740 which are enclosed by a two-part plastic encapsulation 710, 720. The inner plug contact 740 and the two-part plastic encapsulation 710, 720 correspond to the above-described first embodiment. Here too the outer softer plastic encapsulation 710 with the housing 810 can form a press fit when the plug connection is inserted. The outer plug contact 730 however is provided with a peripheral groove 731 which serves for engagement of a spring contact 820, as shown in FIG. 8. In that case the radial force $F_2$ engages the front bearing location which is at the front edge of the groove 735 or in front of same. The front bearing location can be in front of it because there for example there is an additional bearing configuration in the socket (not shown). The radial force $F_1$ at the rear bearing location engages the shoulder 711 of the outer plastic encapsulation 710, in particular in the rear (cable-side) region of the shoulder. The distance L of the two bearing locations from each other can vary in the range of from $L_{min}$ to $L_{max}$ and is at least the diameter d of the outer plug contacts. The plug is inserted as far as the step 712 which then, just as in the first embodiment, bears against the housing 810 of the earphone, of which only a portion is shown in FIG. 8. In addition the plug 700 is held in that position by the spring contact 820 so that the radial force $F_1$ always acts in the rear region of the shoulder.

It will also be seen from FIG. 8 that in this embodiment the shoulder 711 is not circumferential but is in the form of a plurality of noses. They can also be slightly conical, that is to say narrowing slightly forwardly. The precise configuration of the shoulder can however vary. Like other described features like for example the flexible wire, it can also be applied to the respective other embodiment, even if such a combination is not expressly mentioned here.

The invention can advantageously be applied for wired earphones in which the cable is removable. In particular the invention is advantageous if, in addition to fixing of the earphone in the auditory canal, the connection cable is fixed in a position of extending around the auricle.

The invention claimed is:

1. An earphone, comprising:

at least a housing and a removable connection cable, wherein the removable connection cable is releasably fixed to the housing by way of a rotatable plug connection, wherein the connection cable has a coaxial plug having rotationally symmetrical metallic plug contacts, which is surrounded by a plastic encapsulation, wherein when the plug connection is inserted into the housing the plastic encapsulation forms a first bearing location for receiving lateral mechanical forces and at least one of the plug contacts of the coaxial plug forms a second bearing location for receiving lateral mechanical forces, and wherein a distance from the first to the second bearing location is greater than a diameter of the plug contacts of the coaxial plug.

2. The earphone as set forth in claim 1, wherein the plastic encapsulation includes at least an inner first plastic encapsulation and an outer second plastic encapsulation, wherein the second plastic encapsulation surrounds at least a portion of the first plastic encapsulation and comprises a softer plastic than the first plastic encapsulation, and wherein when the plug connection is inserted into the housing at least one portion of the second plastic encapsulation with the housing forms the first bearing location for receiving mechanical forces.

3. The earphone as set forth in claim 1, wherein the metallic plug contacts of the coaxial plug each include an inner and an outer plug contact, a diameter (d) of the coaxial plug being the diameter of the outer plug contact.

4. The earphone as set forth in claim 1, wherein a ratio between the distance from the first to the second bearing location and the diameter of the plug contact is in a range of 1.4-2.5.

5. The earphone as set forth in claim 1, wherein the housing includes an electric socket that matches the coaxial plug of the connection cable and which is at the end of an opening in the housing, wherein a side wall of the opening receives the lateral mechanical forces of the first bearing location, and wherein the opening narrows towards the socket.

6. The earphone as set forth in claim 2, wherein a flexible wire is introduced into the first plastic encapsulation and into a cable encapsulation, that can be put into a form adapted to an auricle for fixing the earphone to the auricle.

7. The earphone as set forth in claim 6, wherein the flexible wire includes a plurality of wires stranded together.

8. The earphone as set forth in claim 1, wherein the inserted plug connection is rotatable with a torque in a range of 0.7-2 Ncm.

9. The earphone as set forth in claim 2, wherein the second plastic encapsulation forms a press fit with the housing when the plug connection is inserted.

10. The earphone as set forth in claim 2, wherein the second plastic encapsulation and/or an opening in the housing for receiving the plug is not rotationally symmetrical.

11. A connection cable for an earphone, comprising:

a coaxial plug having rotationally symmetrical plug contacts of a diameter, and a plastic encapsulation which partially surrounds the plug contacts, wherein the connection cable can be releasably fixed to a housing of the earphone by way of a rotatable plug connection, wherein when the plug connection is inserted into the housing the plastic encapsulation on the housing forms a first bearing location for receiving lateral mechanical forces and at least one of the plug contacts of the coaxial plug forms a second bearing location for receiving lateral mechanical forces, and wherein a distance from the first to the second bearing location is greater than the diameter of the plug contacts of the coaxial plug.

12. The connection cable for an earphone as set forth in claim 11, wherein the plastic encapsulation includes at least an inner first plastic encapsulation and an outer second plastic encapsulation, wherein the second plastic encapsulation surrounds at least a portion of the first plastic encapsulation and comprises a softer plastic than the first plastic encapsulation, and wherein when the plug connection is inserted into the housing at least one portion of the second plastic encapsulation with the housing, forms the first bearing location for receiving mechanical forces.

13. The connection cable for an earphone as set forth in claim 11, wherein the plug contacts of the coaxial plug each include an inner and an outer plug contact, a diameter of the coaxial plug being the diameter of the outer plug contact.

14. The earphone as set forth in claim 1, wherein the coaxial plug is releasable from the plug connection without rotating the coaxial plug, and the plug connection is not releasable through rotating the coaxial plug.

15. The connection cable for an earphone as set forth in claim 11, wherein the coaxial plug is releasable from the plug connection without rotating the coaxial plug, and the plug connection is not releasable through rotating the coaxial plug.

* * * * *